United States Patent [19]

Woodward

[11] 4,184,163

[45] Jan. 15, 1980

[54] BROAD BAND, FOUR LOOP ANTENNA

[75] Inventor: Oakley M. Woodward, Princeton, N.J.

[73] Assignee: RCA Corporation, New York, N.Y.

[21] Appl. No.: 810,733

[22] Filed: Jun. 28, 1977

[30] Foreign Application Priority Data

Nov. 29, 1976 [GB] United Kingdom ..... 49707/76

[51] Int. Cl.[2] ..... H01Q 21/24; H01Q 21/26

[52] U.S. Cl. ..... 343/742; 343/797; 343/890

[58] Field of Search ..... 343/742, 756, 795, 815, 343/853, 855, 728, 732, 741, 748, 788, 867, 797, 890

[56] References Cited

U.S. PATENT DOCUMENTS

| | | | |
|---|---|---|---|
| 2,551,586 | 5/1951 | Dobler et al. | 343/815 |
| 3,231,891 | 1/1966 | Stegen | 343/742 |
| 3,358,287 | 12/1967 | Brueckmann | 343/853 |
| 3,363,255 | 1/1968 | Nienaber | 343/795 |
| 3,541,559 | 11/1970 | Evans | 343/798 |
| 3,771,162 | 11/1973 | Dienes | 343/797 |
| 4,062,019 | 12/1977 | Woodward et al. | 343/797 |

*Primary Examiner*—Eli Lieberman

*Attorney, Agent, or Firm*—Eugene M. Whitacre; Paul J. Rasmussen; Robert L. Troike

[57] ABSTRACT

Four conductive loops are symmetrically disposed in generally a common plane. The loops are closely spaced from each other to be in the strong electromagnetic coupling region of each other. The loops are fed in phase rotation at their inboard portions to provide a broad band circularly polarized antenna.

15 Claims, 11 Drawing Figures

BROAD BAND, FOUR LOOP ANTENNA

BACKGROUND OF THE INVENTION

This invention relates to a broad band antenna and, more particularly, to broad band broadcast antenna capable of broadcasting for example television signals in circular polarization.

Although, horizontally polarized television broadcasting has been almost exclusively used in the U.S.A., it appears from said recent test results, that circularly polarized broadcasting might well improve television reception in large metropolitan areas. The FCC has just recently approved circular polarization for television broadcasting. While circular polarization has been known for some time, one of the major difficulties in providing circular polarization for television is the broad bandwidth required. This is particularly true at the low VHF frequencies where the percentage bandwidth is quite large.

In radio or television broadcasting, it is particularly desirable in many installations to broadcast an omnidirectional pattern so that all receivers at a given radial distance from the broadcaster's antenna receive essentially the same signal strength. Often the broadcasting antennas are mounted or are required to be mounted to a triangular tower which may serve as the support for other antennas. It is therefore desirable for the sake of cost to provide antennas which have a beam width and a structure such that when one is mounted to each side of a typical triangular tower essentially omnidirectional radiation takes place. When there is a requirement for the provision of circularly polarized radiation, additional problems are encountered in mounting the antennas to the reflective towers.

SUMMARY OF THE INVENTION

Briefly, a broadband antenna is provided by four symmetrically disposed conductive loops. The loops are closely spaced from each other and lying in a common plane. The inboard portion of diagonally opposite loops are fed 180° out of phase.

DESCRIPTION OF THE INVENTION

Figure 1:
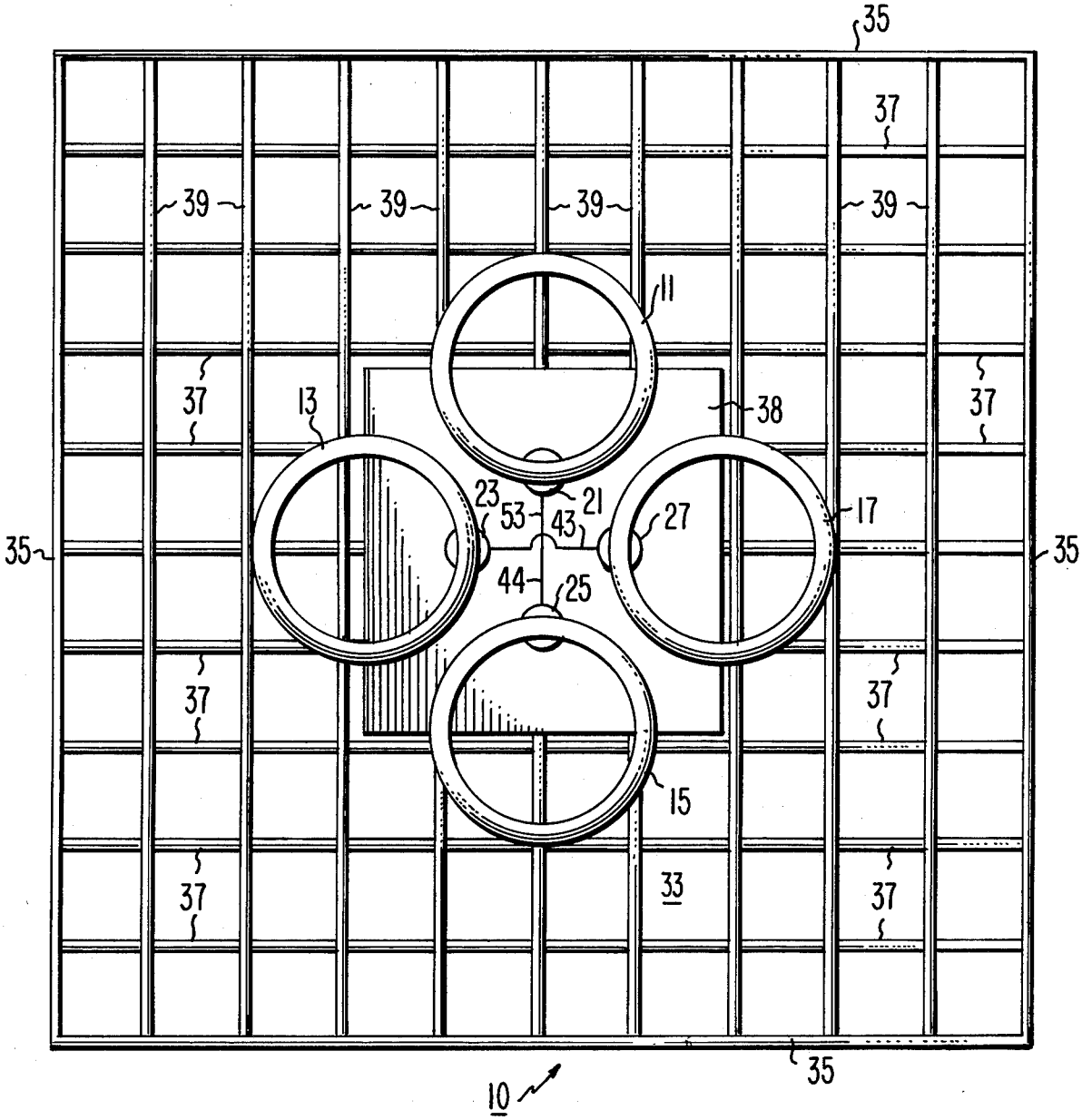
FIG. 1 is a front view of the four loop antenna according to one embodiment of the present invention.
Figure 2:
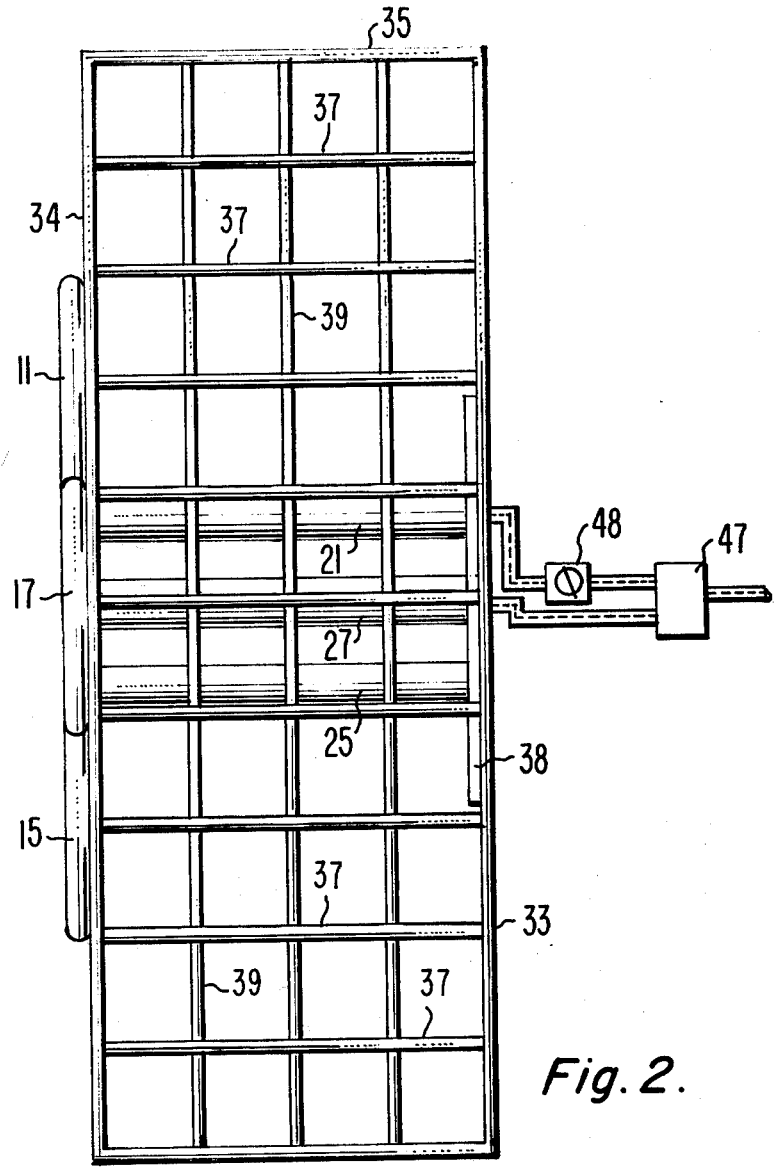
FIG. 2 is a side elevation view of the four loop antenna of FIG. 1.
Figure 3:
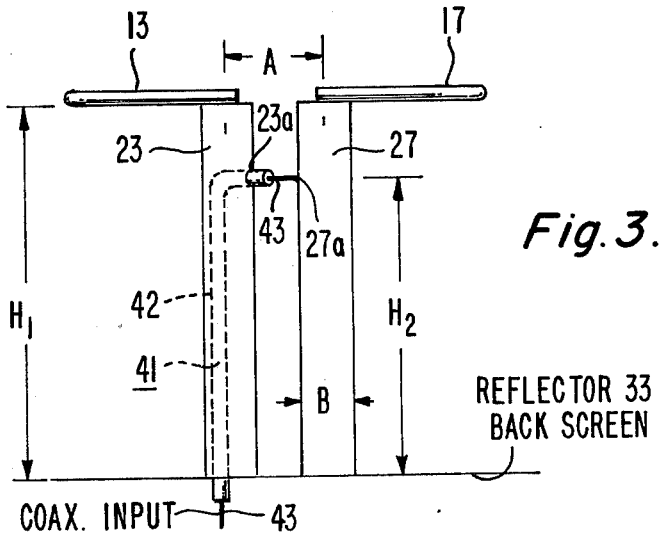
FIG. 3 is a sketch illustrating the feed of FIG. 1.

Referring to FIG. 1, the antenna 10 consists of four symmetrically disposed conductive loops, 11, 13, 15 and 17. The conductive loops 11, 13, 15, and 17, are, for example, circular conductive rings. The loops or rings 11, 13, 15 and 17 are closely spaced from each other and lie generally in a common (coplanar) plane. The rings 13 and 17 extend, for example, in the horizontal direction and rings 11 and 15 extend in the vertical direction. The inboard portions of these loops are energized by a feed network including four support posts 21, 23, 25 and 27. The support post 21 extends perpendicular to a back screen 33 of a reflector 31. (SEE FIG. 2) The reflector 31 is for example a square basket reflector which includes a back screen 33 and side walls 35. The back screen 33 and side walls 35 comprise a grid or mesh of horizontal conductors 37 and vertical conductors 39. The sides 35 of reflector 31 have a depth from the open end 34 to the screen 33 of approximately one-quarter wavelength at the operating frequency of the antenna. The back screen 33 also includes a centered mounting plate 38. The support 21 is coupled at one end to mounting plate 38 and extends perpendicular to the back screen 33 of reflector 31 a distance of approximately one-quarter wavelength to ring 11. Similarly, rings 13, 15 and 17 are supported from the back screen 33 by support members 23, 25 and 27, respectively. The side walls 35 therefore extend from the back screen 33 to a plane that is approximately the plane of the rings or loops. The supports 21 and 23 are hollow and have a coaxial line 41 extending therethrough as illustrated, for example, in connection with FIG. 3. In FIG. 3, the feeding for rings or loops 13 and 17 is illustrated. The coaxial line 41 extends through an aperture **23*a* in support 23 wherein the outer conductor 42 of coax 41 is connected to the support 23 and the center conductor 43 extends in insulated manner through the support 23 and extends out of an opening 23*a*. The center conductor 43 is joined to support conductor 27 at point 27*a*. This structure forms a first balun feed. An orthogonal balun feed is associated with the feeding of loops 11 and 15 wherein a second coaxial conductor passes through the support member 21 and the center conductor 44 is connected to the support member 25. Two center conductors 43 and 44 cross and are separated from each other. When the loops 11, 13, 15 and 17 are fed to provide broad band circular polarization, the coaxial lines extending through supports 21 and 23 are at phase quadrature (90° out of phase). This may be achieved by power dividing signals (see FIG. 2) at divider 47 and passing one of the power divided signals through a 90° phase shifter 48 and through support 21 for example while having the signals supplied through the support 23 undergoing no additional phase shift. In this manner the loops or rings 11, 13, 15 and 17** are fed in the relative rotating of phase of 90°, 180°, 270° and 0°. A circularly polarized antenna was built and tested for operation from 600 thru 800 MHz. The dimensions were as given below: for ring,

| | Inches | Wavelengths at Low End of Band (600 MHz) |
|---|---|---|
| T = the thickness of the Conductor of the rings. | 0.25" | 0.013λ |
| R = the radius of the rings. | 1.0" | 0.051λ |
| S = the space between the | 3.65" | 0.185λ |

-continued

| | Inches | Wavelengths at Low End of Band (600 MHz) |
|---|---|---|
| centers of the rings. | | |
| L = the length between the remote ends of the rings. for balun, | 6.15" | 0.313λ |
| A = the spacing between the centers of the support members. | 1.5" | 0.076λ |
| B = the diameter of the support posts. | 0.75" | 0.038λ |
| $H_1$ = the length of the support tube. | 5.0" | 0.254λ |
| $H_2$ = the spacing of the feed point of the balun from the back screen. | 4.0" | 0.203λ |

The dimensions of the reflector were as follows:

| | | |
|---|---|---|
| sides = | 10" × 10" | 0.51λ × .51λ |
| depth = | 5" | 0.255λ |
| mesh size = | 1.67" | 0.085λ |

The above described design was operated over the frequency band of 600–800 MHz. With this design, the VSWR on a 50 ohm input line was less than 1.3:1. Over this 30% frequency band, the cross coupling between orthogonal inputs was in the range of −30 to −35 dB over the band.

Figure 4:
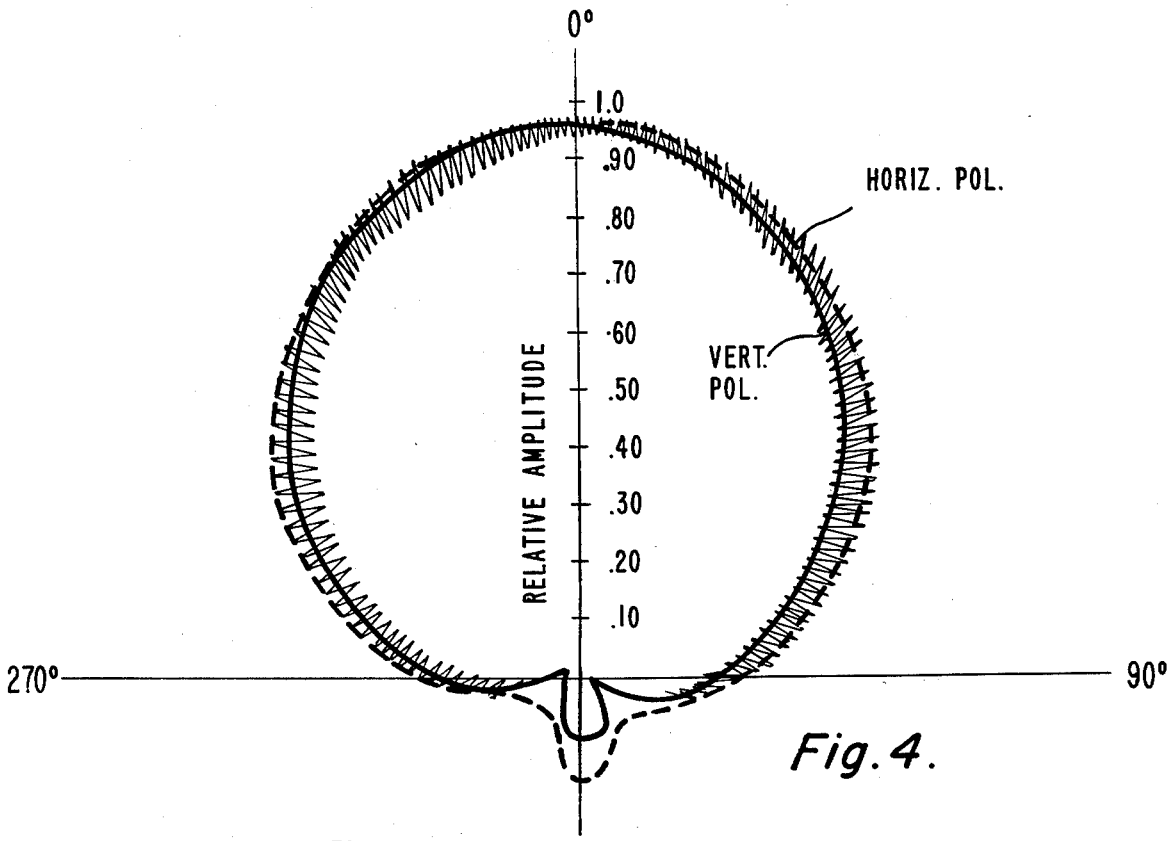
FIG. 4 is an example of the radiation characteristics of the antenna of FIG. 1.

An example of the type of radiation characteristic is given in FIG. 4 at the low frequency end of the band. The two orthogonal dipoles were fed with equal amplitude signals in phase quadrature for this test. The solid curve is the vertically polarized radiation and the dashed curve is the horizontally polarized components. Superimposed on these two curves is the characteristic obtained by rotation of the linearly polarized source antenna at a rapid rate relative to the rotation of the test antenna on its turntable. This then is a graphic plot of the axial ratio for different azimuth orientations of the test antenna. Similar patterns were obtained at the higher frequencies with slightly reduced beam widths.

The design is very simple and gives broad band operation without the need of auxiliary capacitive elements and their associated insulators, or other types of matching devices such as series stubs, transformers, etc. The tests have also shown that the antenna can be matched over the same broad band to a higher characteristic line (75 or 77.5 ohms) merely by making small changes in the ring geometry, reducing H, and raising the balun cross connection (i.e., making $H_1=H_2$). The low weight and low wind loading of the ring radiators are important advantages for TV transmitting antenna applications at the lower TV bands. In addition, heating elements may be placed inside of the rings for deicing in cold weather. The relatively thick tubing of the rings should offer higher power handling than radiators made of flat metal vanes. It is of course apparent that the general concept is not confined to only circular rings; other shapes such as elliptical, square, etc. may possibly offer even greater bandwidths.

Figure 5:
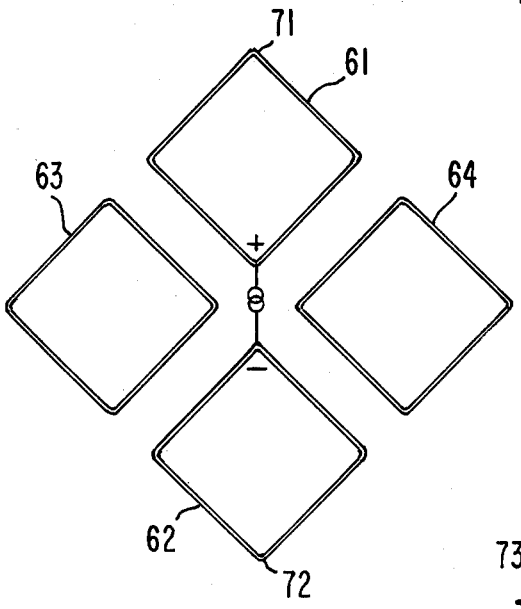
FIG. 5 illustrates a four square loop version of the antenna in accordance with another embodiment of the present invention.

In connection with a square shape, the loops may be as appears in FIG. 5. Sides of the square loops are parallel to each other and the inboard ends point toward each other. These loops are again fed in the same manner discussed above in connection with the rings.

Figure 6:
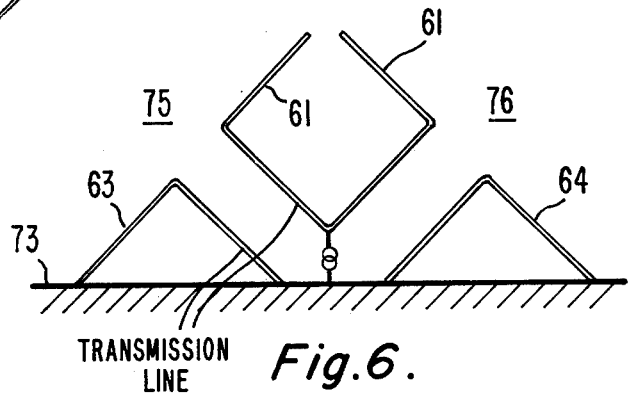
FIG. 6 illustrates a functional circuitry of one-half of the antenna of FIG. 5.
Figure 7:
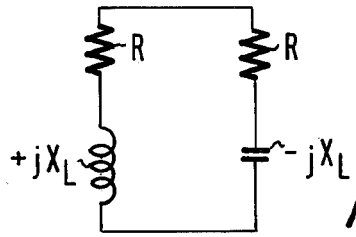
FIG. 7 is an equivalent circuit of each center fed dipole in the square ring version of FIG. 5.

The theory of operation is more easily understood by considering the square loop version in FIG. 5. If the radiating loops 61 and 62 are fed, a neutral plane exists horizontally into the center of the geomtry. In addition, no current flow takes place at points 71 and 72 at the ends of the loops 61 and 62. Hence, these points may be open circuited without altering the current flow in the system. The structure may be redrawn as shown in FIG. 6 with only half of the radiating structure being above the neutral ground plane 73. It is therefore seen that the system can be considered as basically two inclined dipoles 75 and 76 with one end open (at point 71 in FIG. 5) and the opposite end grounded (loop 63 and 64 touching plane 73 in FIG. 6). The mid points of the dipoles 75 and 76 are fed through open wire mesh section formed by the closely spaced sections of the adjacent squares (loops). The two transmission line sections are joined in parallel across one-half of the drive voltage. The input impedance to each transformer is represented as $Z_A$. Each center fed dipole has the equivalent circuit represented in FIG. 7.

Figure 8:
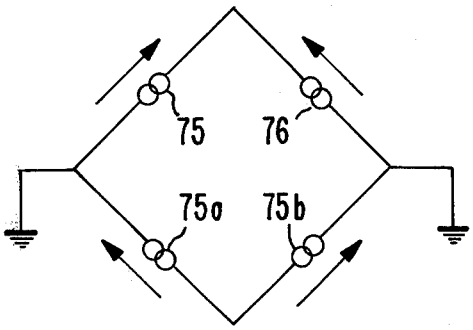
FIG. 8 is a redrawn equivalent circuit of the complete antenna in FIG. 5.
Figure 9:
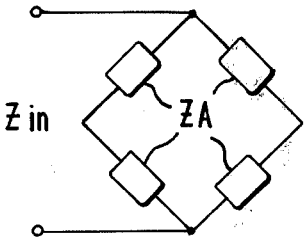
FIG. 9 illustrates the equivalent impedance of the total antenna of FIG. 5.

The major radiating section of the complete antenna may for excitation of loops 61 and 62 in FIG. 5 be redrawn as illustrated in FIG. 8. Since the dipole current is grounded in the grounded half of the element, it is therefore seen that the other portions of the squares (loops 63 and 64 in FIG. 5) contribute to a major part of the radiation for the excitation of loops 61 and 62 of the antenna. The relative spacing between these two sections will also cause the H-plane pattern (horizontal plane) to be narrowed and more closely to the same shape as the E-plane pattern (vertical plane) at the antenna input. The equivalent impedance circuitry is illustrated in FIG. 9. It is seen by observing in FIG. 9 that the input impedance is equal to $Z_A$.

Figure 10:
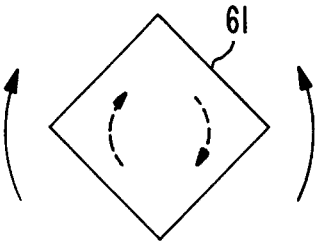
FIG. 10 illustrates the currents in one of the loops of FIG. 5.

Changing the square size (loop size) changes both the dipole lengths and the lengths of the transmission line sections. Changing the spacing between the square rings has a major effect on the characteristic impedance of the line sections and a minor effect on the dipole lengths. Changing the dimensions of the conductors making up the rings has a major effect on the characteristic impedance of the line sections and a minor effect on the dipole impedance. In all cases, each dipole is center fed. It is therefore seen above, for circular polarization, each ring carries two different decoupled modes of current flow which contribute to the major part of the radiation. The current for loop 61 is illustrated for example in FIG. 10. The solid arrow in FIG. 10 represents the current in the loop 61 with loops 61 and 62 excited and dashed arrows represent the current in the loop 61 with loops 63 and 64 excited. There is no cross coupling from the input terminals of loops 61 and 62 to the input terminals of loops 63 and 64. For the case where the antenna is made of round rings as illustrated in FIGS. 1 thru 3, each transmission line section has a taper at both ends and each dipole section is curved instead of being straight.

Figure 11:
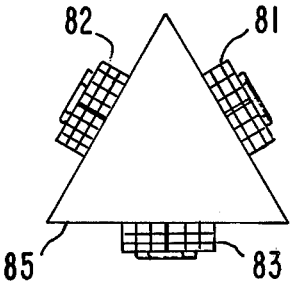
FIG. 11 is a sketch of a top plan view of an omnidirectional antenna system using three radiators like that described in connection with FIG. 1.

Referring to FIG. 11, an omnidirectional broad band antenna system about a triangular tower is provided using three four loop antennas as described above. An omnidirectional antenna system as illustrated in FIG. 11 consists of three radiators 81, 82 and 83 like that described above in connection with FIG. 1 with each radiator mounted to a side of a triangular tower 85. In this manner and because of the relative broad beam pattern provided by the antenna, a circularly polarized omindirectional antenna system is achieved.

What is claimed is:

1. A broad band antenna comprising:

four symmetrically disposed conductive loops closely spaced from each other and lying generally in a common plane to form a four loop cluster, each of said loops being in the closely spaced electromagnetic coupling region of the adjacent loops along a substantial portion thereof to form a transmission line feeding the portion of the loop at the periphery of the cluster and each of said loops having substantial portions along the periphery of the cluster that diverge in substantially opposite directions with respect to the adjacent loops to form four centers of signal radiation about the periphery of the four loop cluster, and means for feeding the inboard portion of a pair of diagonally opposite loops 180° out of phase.

2. The combination of claim 1 wherein, the second diagonally opposite pair of loops are fed 180° out of phase with each other and said adjacent loops being fed in phase quadrature.

3. The combination of claim 1 including, a conductive reflector spaced from said conductive loops.

4. The combination of claim 3 wherein, said reflector has a basket type reflector having a back wall and side walls.

5. The combination of claim 4 wherein the side walls of said reflector extend to generally said plane of said loops.

6. The combination of claim 5 wherein said side walls and said loops extend approximately one-quarter wavelength at an operating frequency of the antenna from the back screen.

7. The combination of claim 1 wherein, said loops are circular rings.

8. The combination of claim 7 wherein the diameter of said rings is less than one-quarter wavelength at said operating frequency.

9. The combination of claim 8 wherein the diameter of said ring is about one-tenth of a wavelength at said operating frequency.

10. The combination of claim 1 wherein the length between remote ends of said diagonally opposite loops is less than one-half wavelength at the lowest operating frequency of said antenna.

11. The combination of claim 10 wherein, said length is about one-third wavelength at said frequency.

12. A broad band circularly polarized antenna comprising:

four symmetrically disposed conductive loops closely spaced from each other and lying generally in a common plane, said loops being in a closely spaced coupling region of the adjacent loops along a substantial portion thereof means for feeding the inboard portion of said loops in the relative phase rotation of 0°, 90°, 180°, and 270°, and a basket type reflector having a back wall and side walls with said back wall spaced from said common plane of said loops and said side walls extending from the back wall to the plane of said loops.

13. The combination of claim 12 wherein, said loops are circular rings.

14. The combination of claim 13 wherein said reflector has a flat reflecting back wall spaced approximately one-quarter wavelength from said common plane of said loops at an operating frequency of said antenna.

15. A broad band omnidirectional circularly polarized antenna system comprising:

a support tower, at least three broad band antennas with each antenna mounted to a side of the support tower, each antenna comprising four symmetrically disposed conductive loops closely spaced from each other and lying generally in a common plane, said loops being in a closely spaced electromagnetic coupling region of the adjacent loops, means for feeding the inboard portion of said loops in rotating phase, and a reflector spaced a given distance from the plane of said loops so that each antenna provides a directional broad beam radiation pattern.

* * * * *